US006045167A

United States Patent [19]

Lauterbach

[11] Patent Number: 6,045,167

[45] Date of Patent: Apr. 4, 2000

[54] AUTOMATIC PUSH BAR

[76] Inventor: Heinrich Lauterbach, Mustleitenstrasse 37, 90571 Schwaig, Germany

[21] Appl. No.: 09/284,601

[22] PCT Filed: Oct. 17, 1997

[86] PCT No.: PCT/DE97/02384

§ 371 Date: Apr. 19, 1999

§ 102(e) Date: Apr. 19, 1999

[87] PCT Pub. No.: WO98/17885

PCT Pub. Date: Apr. 30, 1998

[51] Int. Cl.[7] ..... E05C 5/02

[52] U.S. Cl. ..... 292/62; 292/182; 292/DIG. 21

[58] Field of Search ..... 292/57, 58, 61, 292/62, 65, 71, 181, 182, 229, 335, 336, DIG. 21, DIG. 13, 59, 60, 63, 66, 69

[56] References Cited

U.S. PATENT DOCUMENTS

| | | | |
|---|---|---|---|
| 969,624 | 9/1910 | Hoes | 292/229 |
| 1,030,192 | 6/1912 | Kutz | 292/229 |
| 1,120,521 | 12/1914 | Oborny | 292/61 |
| 1,207,600 | 12/1916 | Morgan | 292/181 |
| 1,321,757 | 11/1919 | Kinzel | 292/63 |
| 1,483,097 | 2/1924 | Kline | 292/62 |
| 1,570,135 | 1/1926 | Emmert | 292/334 |
| 2,448,239 | 8/1948 | Urberauaga | 292/229 |
| 3,579,369 | 5/1971 | Coopersmith | 292/58 |
| 5,032,045 | 7/1991 | Calco | 292/60 |

FOREIGN PATENT DOCUMENTS

| | | |
|---|---|---|
| 422323 | 3/1911 | France . |
| 2504968 | 5/1982 | France . |
| 12786 | 8/1880 | Germany . |
| 44466 | 1/1888 | Germany . |
| 250114 | 4/1926 | United Kingdom . |
| 683245 | 11/1952 | United Kingdom . |

*Primary Examiner*—B. Dayoan
*Assistant Examiner*—Gary Estremsky
*Attorney, Agent, or Firm*—Shoemaker and Mattare, Ltd.

[57] ABSTRACT

A self-acting locking bolt for doors or the like, more particularly furniture doors, comprising at least one receiving part on one door leaf or frame, and at least one locking part on the other door leaf or on a door leaf, the locking part having a control connecting-link for a pin of a bolt guided so as to be movable vertically in the locking part, the said pin projecting sideways out of the locking part, in that the locking part is substantially flush with the top edge or bottom edge of the door leaf, in that the bolt does not project, or projects only slightly, beyond the top edge of the locking part when the door leaf is in an open position and projects beyond the top edge into a matching location in an associated frame part when the door leaf is in a closed position, and in that the receiving part has a recess with which the pin of the bolt may be brought into engagement in the locking operation and is pushed along the connecting-link guide and in wich the pin is located when the door leaf is closed.

9 Claims, 2 Drawing Sheets

AUTOMATIC PUSH BAR

BACKGROUND OF THE INVENTION

This invention relates to a self-acting locking bolt.

If fairly large furniture doors are only locked in the center of the door, over the course of time they will warp. To remedy this, it is conventional practice to bolt at least one door leaf, the so-called fixed door leaf, to the frame at the top and bottom. In recent times a central locking mechanism using so-called drive rods has also been adopted.

SUMMARY OF THE INVENTION

The object of the present invention is to provide a locking bolt with which, in a simple manner, a fixed door leaf or a moving door leaf can be secured at the top and bottom in the frame, or to a door leaf in a surround.

These and other objects of the invention are met by a self-acting locking bolt as described below.

In a self-locking bolt for doors or the like, more particularly furniture doors, comprising at least one receiving part on a door leaf or frame, and at least one locking part on the other door leaf or on a door leaf, according to the invention the locking part has a steering connecting-link for a pin of a bolt guided so as to be movable vertically in the locking part, the said pin projecting sideways out of the locking part, wherein the locking part is substantially flush with the top edge or bottom edge of the door leaf and the bolt does not project, or projects only slightly, beyond the top edge of the locking part when the door leaf is in an open position, and projects beyond the top edge into a matching location in an associated frame part when the door leaf is in a closed position. The receiving part has a recess with which the pin of the bolt may be brought into engagement in the locking operation and is pushed along the connecting-link guide, and in which the pin is located when the door leaf is closed. The receiving part may be fitted to the moving door of a double leaf door or in the frame of a single leaf door.

The bolt is mounted perpendicularly in the locking part and spring-operated in the opposite direction from the frame part. The pin is aligned horizontally in relation to the bolt, and the receiving part and/or the locking part is/are in the shape of a flat parallelepiped, one or more projections being arranged on the reverse side thereof for pinning, secured against rotation, into a furniture part.

On their sides facing towards the frame part, the receiving part and/or the locking part have resiliently mounted, upwardly rounded snap-action studs for releasably snapping into matching recesses in the frame part. The spring for the snap-action stud is mounted on an eccentric disc adjustable from the exterior, by which the spring force can be adjusted.

BRIEF DESCRIPTION OF THE DRAWINGS

The invention is explained in more detail below by way of example, with the aid of the drawings in which.

DESCRIPTION OF THE PREFERRED EMBODIMENT

Figure 1:
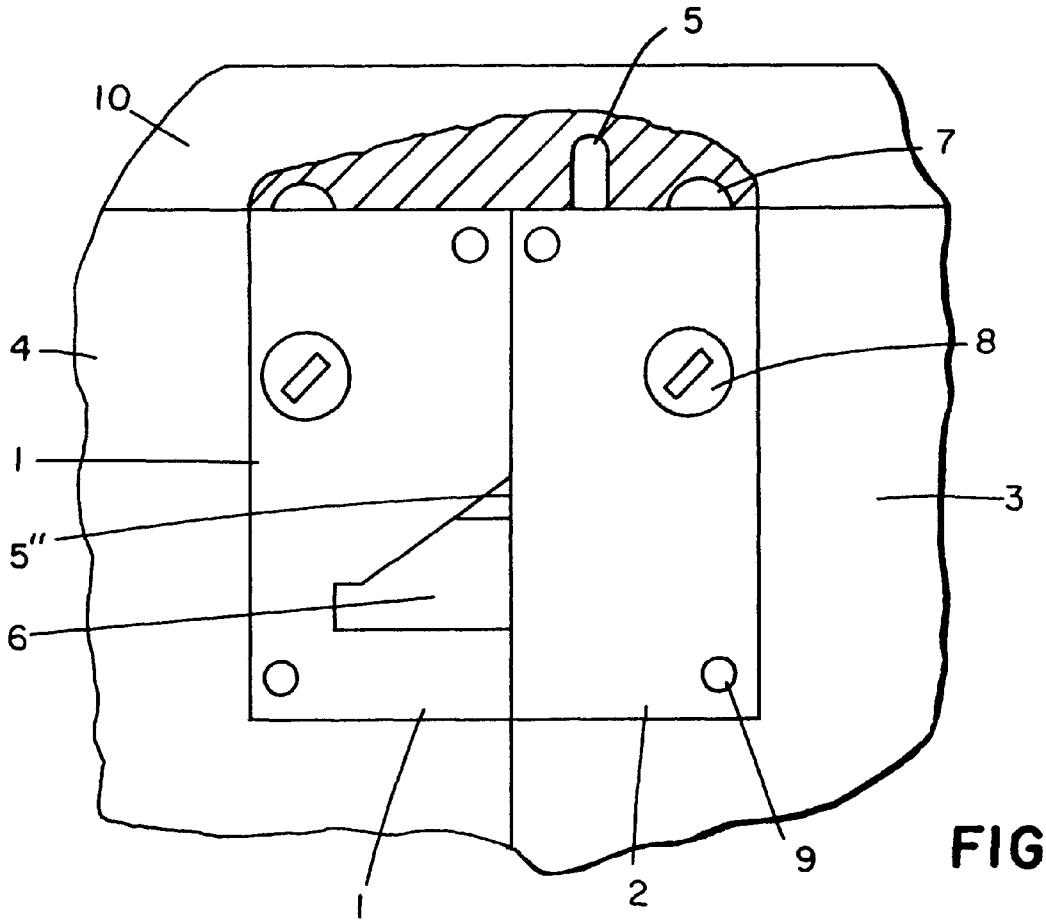
FIG. 1 shows the receiving part and the locking part in a double leaf door in a closed position.

In FIG. 1 the self-acting locking bolt is fitted in a double leaf door 3, 4. The door is closed. The locking bolt comprises a receiving part 1 which is fitted flush in the top right-hand corner in the moving leaf 4, and a locking part 2 which is fitted flush in the top left-hand corner of the fixed leaf 3. Both parts are flat parallelepipeds and are largely identical in structure.

Figure 7:
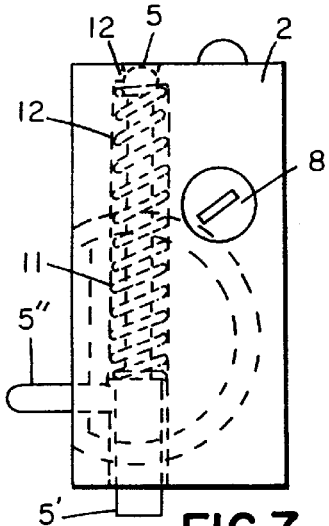
FIG. 7 is a front elevation of the locking part.
Figure 8:
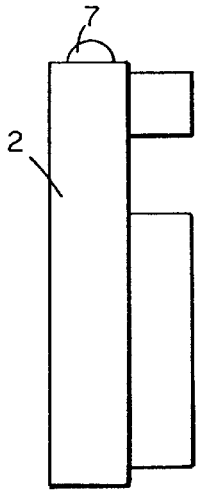
FIG. 8 is a right side elevation of the locking part.
Figure 9:
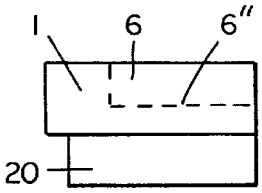
FIG. 9 is a bottom plan view of the receiving part.
Figure 10:
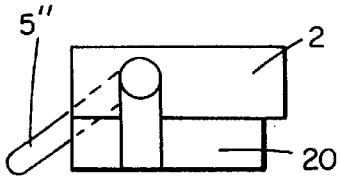
FIG. 10 is a bottom plan view of the locking part.
Figure 11:
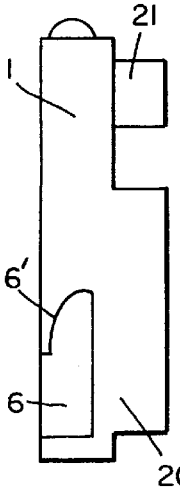
FIG. 11 is a left side view of the receiving part.
Figure 12:
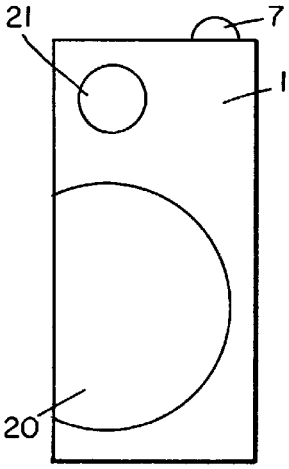
FIG. 12 is a rear elevation of the receiving part.
Figure 13:
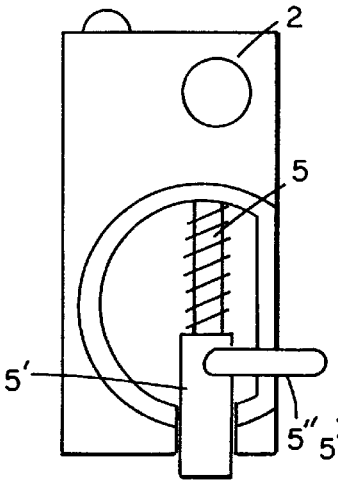
FIG. 13 is a rear elevation of the locking part.

The locking part 2 has a bolt 5, displaceable vertically therein, which in FIG. 1 is extended and engages at the top in a recess of the frame 10 of the door. As may be inferred from FIGS. 7 and 13, the cylindrical bolt 5 has a thickened lower end 5', a compression spring 11 being supported on the flange thus formed, surrounding the bolt 5 and having its upper abutment in a blind hole 12. The compression spring 11 tends to force the bolt 5 downwards to a stop 2" of a pin 5" on the lateral housing wall 2' (FIG. 14), which pin is connected to the said bolt and projects horizontally sideways therefrom, the bolt being fully inserted in the blind hole 12. The bolt 5 emerges at the top through a hole 12' at the top of the blind hole 12 when the pin 5" is moved upwards.

Figure 14:
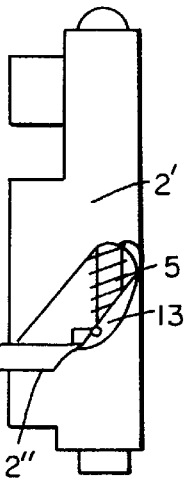
FIG. 14 is a left side elevation of the locking part.

The receiving part 1 has a recess 6 with a catch 6' in which the pin 5" is located, in the closed position represented in FIG. 1. As represented in FIG. 14, the side housing wall 2' has a steering connecting-link 13 for the pin 5", which runs obliquely upwards from the stop 2". If the moving leaf 3 is moved towards the fixed door leaf 4 into the closed position, the tip of the pin 5' which projects horizontally obliquely forwards towards the recess 6 strikes the rear wall 6" of the recess 6. The pin 5" is guided obliquely upwards against the force of the spring 11 along the steering connecting-link 13, producing a rotational movement and an axial, upwardly directed movement of the bolt 5 which engages into the matching recess of the frame part 10, until the closed position shown in FIG. 1 is reached. Fitting respective locking and receiving parts at the top and bottom enables simple automatic locking of the fixed leaf to be achieved.

Correspondingly reversing the elements means that the locking part can also be fitted on the moving leaf and the receiving part on the fixed leaf. It is also possible to fit the receiving part in a door surround and accordingly to fit the locking part in the door, so that the door automatically self-locks when it closes.

Figure 5:
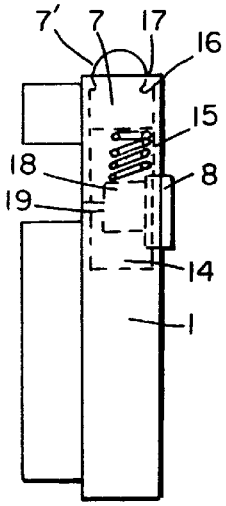
FIG. 5 is a left side elevation of the receiving part.
Figure 6:
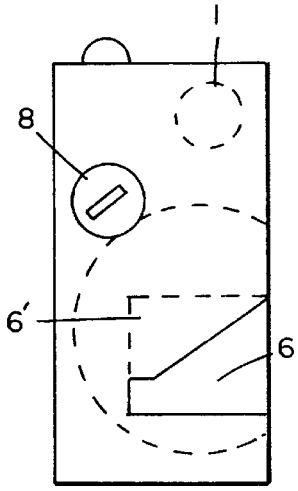
FIG. 6 is a front elevation of the receiving part.

On their upper side facing towards the frame part 10, both the locking part and the receiving part have respective resiliently-mounted snap-action studs 7 which, when the doors are closed, are snapped into matching recesses in the frame part 10. As may be seen from FIG. 5, the snap-action stud 7 is mounted in a blind hole 14 on top of a compression spring 15, and a flange 16 on an inwardly projecting shoulder 17 thereof adjoins the opening of the blind hole 14. When it is snapped into the frame part 10, the snap-action stud is pressed inwards against the spring force. To make this operation easier, it is provided with a spherical cap 7'. Since adjustment of the initial stress of the spring 15 is desirable in order to compensate for tolerances, the said spring is guided on an eccentrically guided, upright disc 18 in the blind hole 14 which is connected to an adjusting disc 8 guided in the receiving part 1 and protruding outwardly therefrom. Rearwardly, the eccentric disc 18 is mounted in the receiving part 1 by way of a shaft stub 19. Depending on the position of the eccentric disc 18, the initial stress of the spring 15 is more or less.

Figure 2:
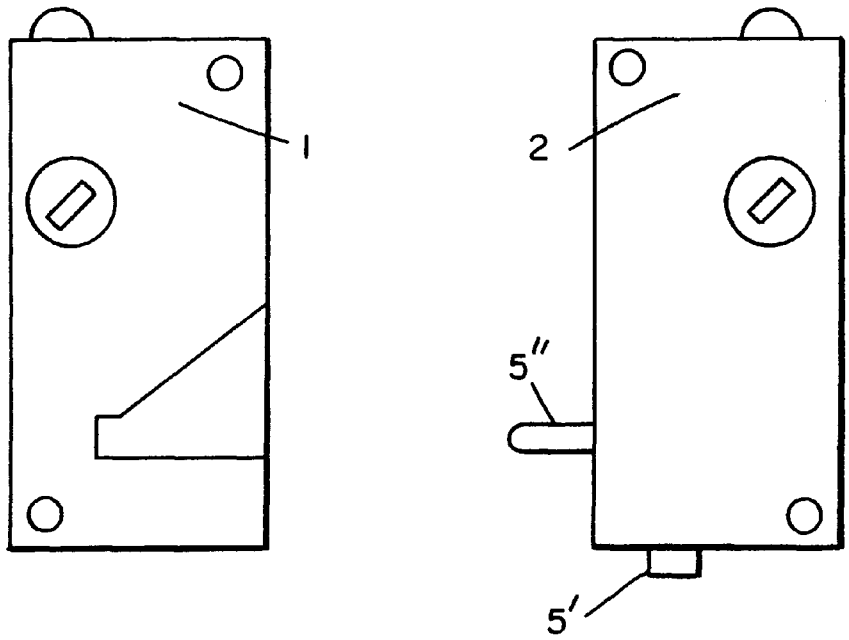
FIG. 2 shows the receiving part and the locking part in an open position.
Figure 3:
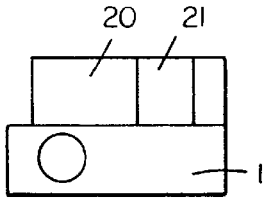
FIG. 3 is a plan view of the receiving part.
Figure 4:
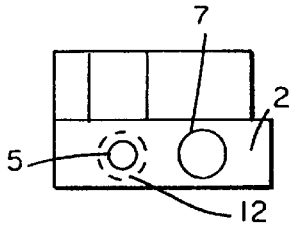
FIG. 4 is a plan view of the locking part.

The receiving part and the locking part are screwed in place in the door leaves by way of holes 9 (FIGS. 1 and 2) or they are pinned, secured against rotation, into matching recesses of the door leaves by means of projections 20, 21 (FIGS. 3, 9–12).

What is claimed is:

1. A self-acting locking bolt for furniture doors, said locking bolt comprising a receiving part having a recess therein, and a locking part, said locking part comprising a vertically slidable bolt, a pin projecting laterally from said bolt, and a steering connecting link for said pin, said locking part being adapted for mounting substantially flush with an edge of a door leaf, so that the bolt does not project substantially beyond said edge when the door leaf is in an open position, said receiving part being adapted to be mounted on an other door leaf or adjacent frame part so that said recess engages the pin of the bolt as the door leaf is closed and is pushed along a connecting-link guide and in which the pin seats when the door leaf is closed, wherein the steering connecting link of the locking part is oriented obliquely upward, so that the pin rotates as the door leaf is being closed, and, when the door leaf is fully closed, the pin lies in said recess in the receiving part.

2. A self-acting locking bolt according to claim 1, wherein the bolt is spring-operated in a direction away from the frame part.

3. A self-acting locking bolt according to claim 1, wherein the pin extends perpendicularly from the bolt.

4. A self-acting locking bolt according to claim 1, wherein the receiving part has the shape of a flat parallelepiped and wherein the receiving part has one or more projections for securing the receiving part against rotation on a furniture part.

5. A self-acting locking bolt according to claim 1, wherein the receiving part has upwardly rounded snap-action studs for releasable snapping into matching recesses in the frame part.

6. A self-acting locking bolt according to claim 5, further comprising a spring for actuating the snap-action studs, and an eccentric disk which is adjustable from outside of the door for preloading said spring.

7. A self-acting locking bolt according to claim 1, wherein the locking part has one or more projections for securing the receiving part against rotation on a furniture part.

8. A self-acting locking bolt according to claim 1, wherein the locking part has upwardly rounded snap-action studs for releasable snapping into matching recesses in the frame part.

9. A self-acting locking bolt according to claim 8, further comprising a spring for actuating the snap-action studs, and an eccentric disk which is adjustable from outside of the door for preloading said spring.

* * * * *